US009055812B2

(12) United States Patent
Fishman et al.

(10) Patent No.: US 9,055,812 B2
(45) Date of Patent: Jun. 16, 2015

(54) MODULAR LABORATORY WORKBENCH

(71) Applicant: Novartis Institutes for Biomedical Research, Inc., Cambridge, MA (US)

(72) Inventors: Mark C. Fishman, Cambridge, MA (US); Toshiko Mori, New York, NY (US); Landon S. Brown, Brooklyn, NY (US)

(73) Assignee: Novartis Institutes for Biomedical Research, Inc., Cambridge, MA (US)

( * ) Notice: Subject to any disclaimer, the term of this patent is extended or adjusted under 35 U.S.C. 154(b) by 42 days.

(21) Appl. No.: 13/801,388

(22) Filed: Mar. 13, 2013

(65) Prior Publication Data

US 2014/0238277 A1 Aug. 28, 2014

Related U.S. Application Data

(60) Provisional application No. 61/768,335, filed on Feb. 22, 2013.

(51) Int. Cl.

| | |
|---|---|
| ***A47B 17/00*** | (2006.01) |
| ***A47B 37/00*** | (2006.01) |
| ***A47B 21/06*** | (2006.01) |

(Continued)

(52) U.S. Cl.

CPC ..... *A47B 37/00* (2013.01); *A47B 21/06* (2013.01); *A47B 13/003* (2013.01); *B01L 9/02* (2013.01); *A47B 2021/064* (2013.01); *A47B 2037/005* (2013.01); *B01L 2200/028* (2013.01)

(58) Field of Classification Search

CPC .. A61B 19/0248; A47B 21/06; A47B 83/001; A47B 13/00; A47B 13/003; A47B 2307/005; A47B 2037/005

USPC ..... 312/209, 195–196; 108/50.02

See application file for complete search history.

(56) References Cited

U.S. PATENT DOCUMENTS

| | | | |
|---|---|---|---|
| 1,765,643 | A | 6/1930 | Allibone et al. |
| 3,920,299 | A | 11/1975 | Propst et al. |

(Continued)

FOREIGN PATENT DOCUMENTS

| | | | |
|---|---|---|---|
| DE | 202008016891 | U1 | 5/2010 |
| WO | WO-97/46140 | A1 | 12/1997 |

OTHER PUBLICATIONS

European Search Report dated Jul. 14, 2014, for EP application No. 14155602.7, 9 pages.

*Primary Examiner* — Hanh V Tran

(74) *Attorney, Agent, or Firm* — Morrison & Foerster LLP

(57) ABSTRACT

Modular laboratory workbenches and work surface accessories are provided. Modular laboratory workbenches may include a spine structure including multiple modules with core passageways for routing utilities. At least one spine structure module may include circuit breakers behind a panel for local electrical power control. The spine structure may include a top with angled faces that provide power outlets, gas terminals, and other utilities. Between angled faces, an accessory support structure may be provided that supports a backsplash in a center channel and provides accessory slots on both sides of the center channel to receive and support interchangeable accessories including monitor arms, tablet arms, gas turrets, supplemental lights, etc. Cantilever brackets of various heights may attach to the spine structure and support work surfaces that are translatable to provide access to the utilities provided on the angled faces of the spine structure.

22 Claims, 8 Drawing Sheets

(51) Int. Cl.
*A47B 13/00* (2006.01)
*B01L 9/02* (2006.01)

(56) References Cited

U.S. PATENT DOCUMENTS

| | | | | | |
|---|---|---|---|---|---|
| 4,224,769 | A * | 9/1980 | Ball et al. | 52/36.1 |
| 5,038,539 | A * | 8/1991 | Kelley et al. | 52/239 |
| 5,058,331 | A * | 10/1991 | Epps | 52/36.1 |
| 5,081,808 | A * | 1/1992 | Bastian et al. | 52/220.7 |
| 5,103,741 | A * | 4/1992 | Grund et al. | 108/101 |
| 5,499,868 | A * | 3/1996 | Schainholz | 312/236 |
| 5,746,488 | A * | 5/1998 | LaCour | 312/196 |
| 6,138,583 | A * | 10/2000 | Mahone et al. | 108/108 |
| 6,152,048 | A * | 11/2000 | Vander Park | 108/50.02 |
| 6,267,064 | B1 * | 7/2001 | Ostertag et al. | 108/50.02 |
| 6,283,043 | B1 * | 9/2001 | Stern et al. | 108/50.02 |
| 6,463,862 | B1 | 10/2002 | Kuhlman et al. | |
| 6,725,784 | B2 * | 4/2004 | Crinion | 108/64 |
| 7,036,438 | B2 * | 5/2006 | Okamoto et al. | 108/153.1 |
| 7,143,552 | B2 * | 12/2006 | Vander Park | 52/220.7 |
| 7,407,392 | B2 * | 8/2008 | Cooke et al. | 439/131 |
| 8,197,091 | B1 | 6/2012 | Kyle et al. | |
| 2003/0070377 | A1 * | 4/2003 | Waalkes et al. | 52/481.2 |
| 2004/0082334 | A1 * | 4/2004 | Petrick et al. | 455/450 |
| 2007/0040483 | A1 * | 2/2007 | Arkay-Leliever | 312/194 |
| 2007/0204537 | A1 * | 9/2007 | Bastian et al. | 52/220.7 |
| 2008/0035034 | A1 * | 2/2008 | Morita et al. | 108/143 |
| 2008/0224582 | A1 * | 9/2008 | Boland | 312/330.1 |
| 2009/0293402 | A1 * | 12/2009 | Hamilton et al. | 52/481.2 |
| 2010/0066148 | A1 * | 3/2010 | Matthews | 297/423.12 |
| 2010/0126394 | A1 * | 5/2010 | Burak et al. | 108/186 |
| 2011/0072633 | A1 * | 3/2011 | Henriott et al. | 29/428 |
| 2011/0297051 | A1 * | 12/2011 | Martin et al. | 108/25 |

* cited by examiner

MODULAR LABORATORY WORKBENCH

CROSS-REFERENCE TO RELATED APPLICATIONS

This application claims priority to U.S. Provisional Patent Application Ser. No. 61/768,335, filed Feb. 22, 2013, the entire disclosure of which is hereby incorporated by reference in its entirety for all purposes.

BACKGROUND

1. Field

This application relates generally to workplace furniture and, more specifically, to a modular laboratory workbench for use in chemistry laboratories, biology laboratories, and the like.

2. Related Art

Designers, architects, developers, and the like typically strive for both functional and aesthetically pleasing use of work spaces. Laboratory designs pose a challenge of efficiently using available space while trying to anticipate the needs of laboratory technicians and other employees. To accommodate the various needs of laboratory technicians, varying work spaces may be provided in the same laboratory area. For example, work surfaces may be provided for use while a technician is standing, enabling easy transfer of chemicals and the like from nearby cabinets or other storage areas, and those surfaces may be outfitted with power outlets, lighting, gases, and other utilities to support laboratory equipment. Other work surfaces may also be provided for use while a technician is seated, and those surfaces may be outfitted with power outlets, network jacks, and the like to support computers. Still other arrangements may be provided including appliances, sinks, storage units, shelves, and the like.

However, attempting to predict the needs of laboratory technicians when laying out a laboratory space may lead to inefficient use of the space and a less than ideal mix of work spaces. Technician needs may also change over time, and the demands of different projects may make different work spaces more or less useful. For example, laboratory work requiring frequent sample testing may be performed best with multiple standing-height work surfaces outfitted with utilities to support testing equipment. On the other hand, laboratory work requiring frequent reference to online resources or computer applications may be performed best with seated-height work surfaces outfitted for computers and computer monitors. Technician preferences may also make different arrangements more or less useful. For example, some technicians may prefer to use tablet computers rather than desktop or laptop computers, and existing work spaces may be ill equipped to accommodate varying computer resources.

Thus, an improved laboratory workbench that is easily configurable to accommodate varying technician needs and preferences is desired.

SUMMARY

In one exemplary embodiment, a modular laboratory workbench may include a spine structure defining a passageway for routing one or more utilities. The workbench may include an accessory support structure attached to the spine structure. The accessory support structure may be attached to a top portion of the spine structure and may extend up therefrom. The accessory support structure may run longitudinally along the spine structure. The accessory support structure may hold a backsplash, and may further include accessory slots that may support work surface accessories. The workbench may also include two or more cantilever brackets attached to the spine structure with two or more work surfaces attached to the two or more cantilever brackets. The two or more work surfaces may be positioned above the spine structure, and the accessory support structure may extend above the two or more cantilever brackets.

In another exemplary embodiment, a modular laboratory workbench may include a spine structure for supporting two or more translatable work surfaces. The spine structure may include two parallel walls defining a passageway for routing one or more utilities. The spine structure may also include two angled faces positioned atop the parallel walls and angled toward each other. The workbench may also include an accessory support structure attached to a top portion of the spine structure and extending up therefrom. The accessory support structure may run longitudinally along the spine structure. The accessory support structure may include a center channel and a plurality of accessory slots on both sides of the center channel. The center channel may receive and hold a backsplash, and the accessory slots may receive and hold work surface accessories. The workbench may also include two or more cantilever brackets attached to the spine structure with two or more translatable work surfaces attached to the two or more cantilever brackets. The two or more work translatable surfaces may be positioned above the spine structure, and the accessory support structure may extend above the two or more cantilever brackets.

BRIEF DESCRIPTION OF THE FIGURES

The present application can be best understood by reference to the following description taken in conjunction with the accompanying drawing figures, in which like parts may be referred to by like numerals.

DETAILED DESCRIPTION

Figure 1:
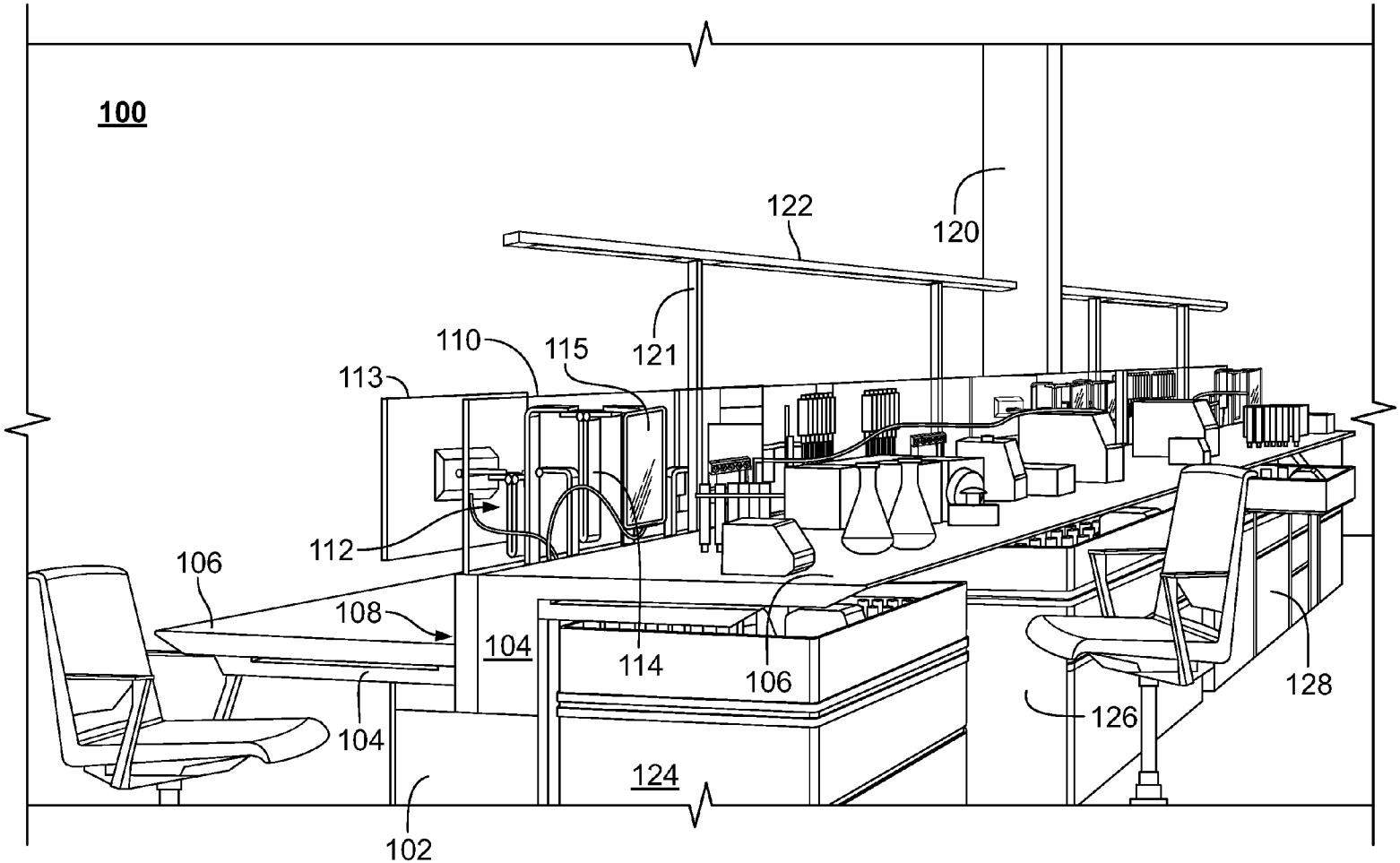
FIG. 1 illustrates an exemplary modular laboratory workbench with movable storage modules.

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below relating to a modular laboratory workbench that is easily configurable to satisfy varied laboratory needs. A modular laboratory workbench may include a spine structure that is semi-permanently attached to a laboratory floor (e.g., by screws, bolts, etc.). The spine structure may include parallel walls defining a core passageway near the base that runs the length of the workbench and includes built-in electrical wiring, water plumbing, gas plumbing, network cabling, pressurized air plumbing, vacuum plumbing, exhaust air plumbing, waste water plumbing, and the like to make these utilities and services available at intervals for use at the workbench surface. Individual spine structure modules may be abutted next to one another, and the utilities from one spine module may pass from one module to the next or be coupled to the utilities of the next spine module in a chain using typical coupling methods (pipe fittings, screws, hoses, electrical plugs, network cables, and the like). In one embodiment, a set of interconnected spine modules may include a source spine module that is connected to sources of each utility. For example, the source spine module may be connected to the building's electrical supply, water supply, gas supply, computer network, and the like. The source spine module, a module that receives the electrical supply, or a module at the end of a row of modules may include circuit breakers (i.e., 15-30 circuit breakers) behind a hinged door, cover plate, or panel. Circuit breakers may provide local electric overload protection near the point of use, beneficially replacing more distant building circuit breakers, and reducing the number of electrical wires that must be routed to the workbench.

The spine modules may be configured to receive angled support brackets (or cantilever arms) for supporting work surfaces on either side of the spine. The support brackets may be provided in a variety of heights, thereby enabling adjustment of work surface heights as desired by replacing existing support brackets with support brackets of the desired height. The support brackets may engage with and support work surfaces using a cantilever design. In one embodiment, the work surfaces may be attached to the support brackets with slides, glides, rollers, or the like to allow the work surface to be slid in a direction perpendicular to the spine. Sliding a work surface away from the spine may provide easy access to an angled portion of the spine that is outfitted with power outlets, gas terminals, network data terminals, water supply connections, and the like. These utilities may be provided at spaced intervals along a spine module and/or repeated along the length of multiple connected spine modules. The work surface may be configured with a narrow gap in the back (near the spine) to allow routing of cables, hoses, and the like from the utilities on the angled spine portion beneath the work surface up to the top of the work surface. A narrow wire basket may be provided beneath the angled spine portion to hold excess cable, excess hose, and the like, thereby minimizing the work surface space occupied by cables, hoses, and the like. In some embodiments, the wire basket may be welded onto a spine structure panel or cover.

In addition to supporting the work surfaces and providing utilities, the spine modules may receive and support an accessory support structure that runs longitudinally along the spine structure and may be narrower than the spine structure base. The accessory support structure may provide a central channel for holding a glass backsplash and accessory slots or channels on either side of the central channel for receiving various work surface accessories. The accessory slots may be at a height equal to or above the work surfaces (which may be at different heights on different sides of a workbench). The accessory slots may be configured to receive and hold a variety of accessories for configuring the work surface for laboratory needs. For example, a monitor arm (which may be adjustable) may be configured to secure into a slot and hold a computer monitor. Other accessories may include a tablet arm, supplemental power strip, supplemental light, gas turret, pipette holder, and the like. Each of the accessories may be configured with the same interface for engaging the accessory slots (e.g., pressure fitting, screws, bolts, tabs, or the like). As such, work surface accessories may be interchangeable, and work surfaces may thus be customized and modified based on laboratory needs. Unused accessory slots may be fitted with placeholders to prevent dust or other debris from entering the slots. Beneficially, the narrow space occupied by an accessory support structure may provide a more sleek look than prior designs as well as functionally providing additional work surface space than prior designs that may have extended the wider spine structure above the height of the work surface (and in some cases all the way to the ceiling).

In addition to holding a backsplash and providing accessory slots, the accessory support structure may also engage with and support task lights that may extend, for example, directly above the backsplash in the central channel of the accessory support structure, or individual accessory support structures may be separated by task lights that are attached directly to the spine structure. Task lights may have columns or stems that route electrical wiring to the spine and attach to the accessory support structure. The columns or stems may separate and support the sides of backsplashes at different intervals along a workbench. In one embodiment, accessory support structures with backsplashes may interface with task light stems to provide mutual structural support. The task lights may include light emitting diode (LED) bulbs for illuminating the work surfaces. A button or switch may be provided on the task light stems for controlling the lights.

Beneath work surfaces, various movable storage modules may be provided. For example, under a work surface configured as a seated-height desk, a module may be provided with desk drawers and a top configured to hold a laptop computer. Other storage modules may include various sized drawers, cabinets, and the like for holding laboratory equipment, containers, chemicals, tools, files, etc. Thus, in addition to customizing the work surface height and work surface accessories, storage modules beneath the work surface may also be interchanged to further customize a workbench based on laboratory needs. Configuring the overall workbench with under-bench storage may free up space above the workbench that in other designs may be occupied by cabinets that obstruct the view and may lead to a feeling of small, closed spaces. In particular, the open designs discussed herein may encourage collaboration and a sense of community, and give personnel a feeling of spaciousness by leaving upper portions of the workbench open.

Throughout this disclosure, like numerals may be used to refer to similar parts, although variations will be apparent, and the illustrated examples are not exclusive of other embodiments. For example, work surface 106 of FIG. 1 may be the same as or similar to work surfaces 306 and 406 of FIG. 3 and FIG. 4, respectively.

FIG. 1 illustrates exemplary modular workbench 100 with movable storage modules 124, 126, and 128. In one embodiment, modular workbench 100 may include spine structure 102 (or multiple spine structure modules 102) for securing the workbench to the floor and supporting workbench elements. Spine structure 102 may include a rectangular base constructed of steel or other metals capable of providing structural support to the workbench. Spine structure 102 may be semi-permanently or permanently attached to the floor (e.g., floor slab) of a laboratory space using screws, bolts, nails, adhesives, or the like.

Although not shown in FIG. 1, spine structure 102 may include parallel walls defining a hollow portion or core passageway within spine structure 102 for built-in electrical wiring, water plumbing, gas plumbing, network cabling, pressurized air plumbing, vacuum plumbing, exhaust air plumbing, waste water plumbing, and the like to make these utilities available at intervals for use at the surface of workbench 100. These utilities (and others that may be included) may be supplied to one or more spine structure modules and then distributed to other spine structure modules in a chain along a workbench through the hollow portions or core passageways of adjacent spine structure modules. For example, modular workbench 100 may receive electricity, water, gas, network data, and the like from vertical chase 120. Cables, hoses, pipes, and the like may be distributed in the ceiling of a laboratory space and routed down vertical chase 120 to supply modular workbench 100. In the illustrated embodiment, only one vertical chase is used, but in other embodiments, multiple chases may be desired. Although modular workbench 100 is illustrated with vertical chase 120 near the center of the workbench, in other embodiments, vertical chase 120 may be positioned at the extreme ends of the workbench or in any other position. In some embodiments, vertical chase 120 may include a hinged door or removable panel for accessing utilities routed through vertical chase 120.

Spine structure 102 may be configured to receive support brackets 104 (or cantilever arms 104). Support brackets 104 may attach to spine structure 102 and support work surfaces 106 as cantilever arms. In one embodiment, spine structure 102 may include slots on either side for receiving a portion of each of support brackets 104. The slots may be sized such that support brackets 104 are fully supported once inserted into the slots, and the cantilever design of support brackets 104 may allow them to fully support work surfaces 106 and objects thereon. In other embodiments, other attachment mechanisms may also be provided such as screws, bolts, clips, and the like. Support brackets 104 may be provided in a variety of heights to enable customization of the work surface height. For example, as illustrated in FIG. 1, support bracket 104 on the left is shorter than support bracket 104 on the right. Work surface 106 on the left is thus at a lower height than work surface 106 on the right, which may, for example, accommodate seated work on the left and standing work on the right. Multiple support bracket heights may be provided at a variety of different heights to accommodate laboratory needs as well as the varied heights of laboratory technicians. In some embodiments, individual work spaces may be sized differently than adjacent work spaces, thereby customizing the work space for each technician.

Work surfaces 106 may be attached to support brackets 104 in a variety of ways. In one embodiment, work surfaces 106 may be attached to support brackets 104 using slides, glides, rollers, or the like to enable work surfaces 106 to slide perpendicularly away from spine structure 102 and the center of the work bench, thereby providing access to utilities under the work surface as will be discussed in further detail below. In other embodiments, work surfaces 106 may be semi-permanently or permanently affixed to supports brackets 104 using screws, bolts, adhesives, or the like.

In addition to receiving and holding support brackets 104, spine structure 102 may also receive and hold accessory support structure 108, which may run longitudinally along spine structure 102 and be attached to spine structure 102 with brackets, screws, bolts, or the like. Accessory support structure 108 may be narrower than spine structure 102, which may provide a subdued, sleek look to the workbench as well as offer more usable work surface space than prior designs where the spine structure may have extended above the work surface and occupied similar space both below and above the work surface height. Accessory support structure 108 may include a center channel for receiving and holding backsplash 110. Backsplash 110 may be made of glass, plastic, metal, or any of a variety of other materials as desired. In some examples, backsplash 110 may be configured with one material on the lower portion (e.g., glass) and a different material on the upper portion such as a metal bar for providing a magnetic surface to hold papers and the like. On either side of the center channel, accessory support structure 108 may include accessory slots at intervals along the length of accessory support structure 108. Accessory slots in accessory support structure 108 may provide work surface customization using a variety of accessories. For example, monitor arm 112 may be inserted into one accessory slot to support computer monitor 113. Monitor arm 112 may be adjustable such that a user can adjust the angle, tilt, vertical position, and horizontal position of monitor 113 (i.e., six degrees of freedom). For a different user with different preferences, tablet arm 114 may be inserted into a different accessory slot to support tablet computer 115. Tablet arm 114 may be similarly adjustable such that a user can adjust the angle, tilt, vertical position, and horizontal position of tablet 115. Monitor arm 112 and tablet arm 114, when inserted in an accessory slot, may each have portions that rest on or near backsplash 110, providing additional support.

In addition to supporting backsplash 110 and various accessories, accessory support structure 108 may also interface with and support task light 122. Accessory support structure 108 may include a slot for receiving column or stem 121 of task light 122, which may both secure task light 122 as well as provide a conduit for electrical wiring to supply power to lighting elements in task light 122. In another embodiment, accessory support structure may not include a slot for receiving stem 121, but instead stem 121 may be directly attached to spine structure 102 and may separate two accessory support structures that may include channels or tabs for interfacing with the stem 121 on the sides. Column or stem 121 may be at least partially hollow or may include a conduit for electrical wiring to power lighting elements in task light 122. Column or stem 121 may also include one or more buttons, switches, or other elements for controlling the lighting elements of task light 122 (e.g., turning them on and off, adjusting the intensity, etc.).

Modular workbench 100 may be provided with a variety of storage modules such as storage modules 124, 126, and 128. Storage modules 124, 126, and 128 may include casters (which may be selectively locked to prevent rotation) enabling them to be repositioned as desired. In some embodiments, storage modules may not be affixed to spine structure 102, but in other embodiments, a mechanism may be provided to at least temporarily secure storage modules to spine structure 102 or another element of workbench 100 to provide additional support to the storage modules. As illustrated, storage modules 124, 126, and 128 may include a variety of drawers, cabinets, shelves, and the like of varying sizes to provide users with a variety of options for work space customization. Other storage module configurations are also possible that may be determined based on laboratory needs, which will be apparent to those of ordinary skill in the art.

Figure 2:
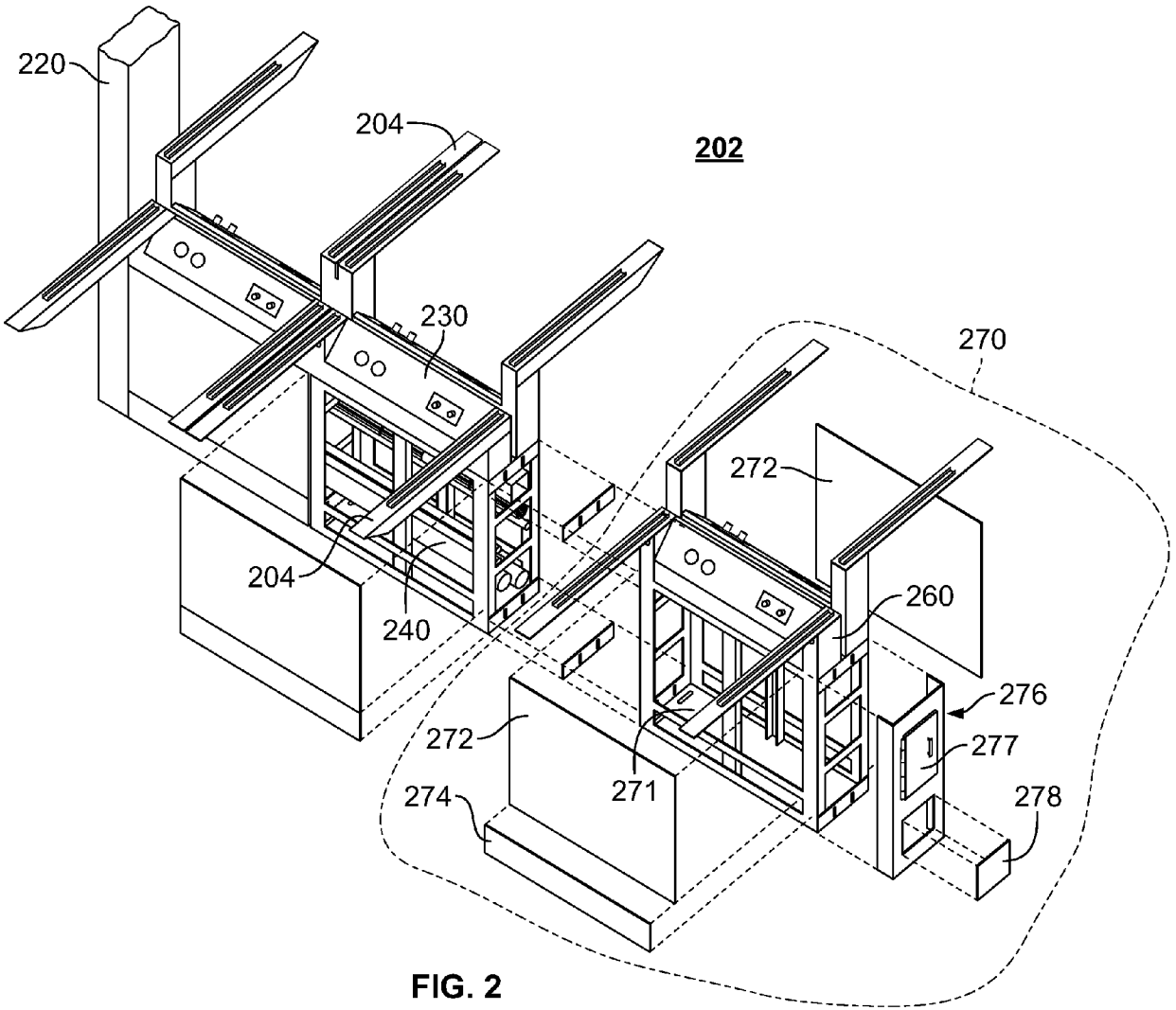
FIG. 2 illustrates a spine structure of an exemplary modular laboratory workbench.

FIG. 2 illustrates a detailed view of spine structure 202, which may be the same as spine structure 102 of FIG. 1. Spine structure 202 may include multiple spine structure modules 270 that may be of the same or similar size. Adding or removing spine structure modules may allow users to customize the size of a workbench as well as alter the size and configuration of a work bench as desired (e.g., as needs change). Vertical chase 220 may be provided to route utilities from the ceiling of a laboratory to one or more spine structure modules, and the source module or modules may distribute utilities to adjacent modules. As illustrated in FIG. 2, vertical chase 220 may be provided at one extreme of a workbench and used to supply all subsequent modules attached in series to the source module. In some embodiments, vertical chase 220 may include a hinged door or removable panel to provide access to utilities routed therein.

Each spine structure module 270 may include a rectangular base structure 271 with parallel walls on the sides for supporting the work bench and all work bench elements. Within rectangular base structure 271 may be a core passageway or hollow portion 240 (between two parallel walls) for routing hoses, cables, pipes, and the like to supply utilities to the workbench as discussed herein. In one embodiment, sections of hose, cable, pipe, and the like may be provided in each spine structure module 270, and each of those sections may be connected to a source (i.e., from vertical chase 220), connected to matching sections in adjacent modules, or capped to terminate a series (i.e., at the end of a chain of modules). In another embodiment, modules 270 may be configured with designated spaces for receiving hoses, cables, pipes, and the like after being installed in position (i.e., plumbing may be routed through these spaces and various connections made after rectangular base structure 271 is fixed in place).

Rectangular base structure 271 may also include slots for receiving and securing support brackets 204 (which may be of varied heights and use a cantilever design to support work surfaces as discussed with reference to FIG. 1). In one embodiment, each spine structure module may be configured to receive a support bracket in each of its four corners. When abutted adjacent to another spine structure module, two support brackets may also be abutted adjacently. By configuring each module to receive and hold its own set of support brackets, varying height support brackets may be utilized on different sides of a workbench and for adjacent modules. For example, a pair of support brackets with a first height may be installed on one side of a module, a pair of support brackets with a second height may be installed on the other side of a module, a pair of support brackets with a third height may be installed on one side of an adjacent module, and so on, providing varied work surface heights that may be configured and adjusted as desired (i.e., based on changing laboratory needs, changing personnel, etc.).

Adjacent spine structure modules 270 may be connected together using screws, bolts, clips, or the like, and some or all spine structure modules 270 may be affixed (permanently or semi-permanently) to a laboratory floor to provide structural support to the workbench. For ease of installation, spine structure modules 270 may include panels 272, 274, 276, and 278 that may be affixed to rectangular base structure 271 before or after structure 271 is attached to the floor and to other spine modules. Panels 272, 274, 276, and 278 may also be removable to provide access to wiring, hoses, pipes, and the like.

Spine structure 202, and each spine structure module 270, may include a top portion with angled top faces 230 on either side of the structure that angle in toward the center (i.e., forming a triangular prism shape that may be separated or have a gap in the center). Angled faces 230 may be separated in the middle by a channel or face for receiving and securing an accessory support structure that may run longitudinally along spine structure 202 (e.g., accessory support structure 108 of FIG. 1 discussed above). As discussed in more detail below, angled faces 230 may provide power outlets, gas terminals, network data terminals, water supply connections, and the like for supplying these utilities to users and the work surface. Users may access angled faces 230 by sliding a work surface away from the center of the spine structure. In other embodiments, each spine structure module 270 may include a top portion having a flat horizontal surface, curved surface, or the like (i.e., without angled top faces 230), and may include slots, channels, or other engagement mechanisms for receiving an accessory support structure (e.g., accessory support structure 108 of FIG. 1).

One or more spine structure modules 270 may also include a circuit breaker panel 277 (i.e., 15-30 circuit breakers in a panel) installed in an end that is accessible to laboratory personnel (i.e., in a module at the end of a row of modules that is not blocked by a wall or vertical chase or other structures). In one embodiment, circuit breakers 277 may be installed behind a hinged door that may occupy a portion of panel 276. In other embodiments, a removable panel may be attached using magnetic clips to provide easy access to circuit breakers 277. In still other embodiments, panel 276 may be a smooth faced panel that may not be broken up by panels 277 or 278, and it may be attached with clips, magnetic clips, or similar attachment mechanisms that may allow the panel to be removed without tools. In such embodiments, a circuit breaker panel 277 may be located behind panel 276 and made accessible when panel 276 is removed.

Circuit breakers 277 may receive an electrical power line directly from a building's main line, effectively relocating circuit breakers that are typically installed in a basement or utility room in a nearby location making it easier for laboratory personnel to reset tripped breakers as well as to selectively turn power on and off to certain workbench sections. Additionally, locating circuit breakers 277 within a workbench may reduce the impact of tripped breakers on other portions of the building and the laboratory itself. For example, in traditional arrangements, a tripped circuit breaker may cause the power to be cut from all or many power outlets in a laboratory, and may even cut power from lighting and other laboratory elements. However, by providing a local circuit breaker in a workbench, the impact of a tripped breaker can be minimized, and laboratory personnel can gain easy access to breakers to reset them as necessary.

Moreover, by including local circuit breakers in a workbench, electrical wiring can be reduced and conduit space saved over typical electrical designs. For example, in typical building layouts, a main electrical supply line may be routed to central circuit breakers (e.g., in a utility room). From there, overload-protected power supply lines may be routed to various locations throughout a building. In some laboratories, multiple different overload-protected power supply lines from multiple different circuit breakers may be routed from the central circuit breakers in the utility room to various areas in a laboratory. In contrast, by locating circuit breakers within a work bench, the same main power supply line may be routed from the building's supply and distributed to each of the workbench circuit breakers in a laboratory (as well as to other building circuit breakers). From there, the multiple different overload-protected power supply lines on multiple different circuit breakers need only be distributed to different areas of the workbench through the spine structure as opposed to routing those wires through walls, ceilings, and the like. In this manner, a workbench may beneficially be provided with several separately protected electrical circuits without the high costs of routing separate wires for each separate circuit from distant circuit breakers to each area of a workbench (reducing the wiring distance to at most the length of the workbench). In some embodiments, the number of circuit breakers may correlate to the number of spine structure modules 270 in a row: one, two, or more circuit breakers may be provided for each spine structure module 270 in a row of spine structure modules to provide individualized power control and overload protection for each spine structure module 270.

In another embodiment, local circuit breakers may be provided behind a hinged door or removable panel in a vertical chase such as vertical chase 220 of FIG. 2. As discussed above, various utilities may be routed from a laboratory ceiling down vertical chase 220 to supply the workbench. Included in those utilities may be the main building electrical power supply line. The building power supply line may be routed to multiple circuit breakers in a panel of vertical chase 220. From there, the multiple overload-protected power supply lines may be routed into adjacent spine structure modules and throughout a workbench. In some embodiments, one or more additional panels or hinged doors may be provided on vertical chase 220 for accessing the utilities routed therein.

Figure 3:
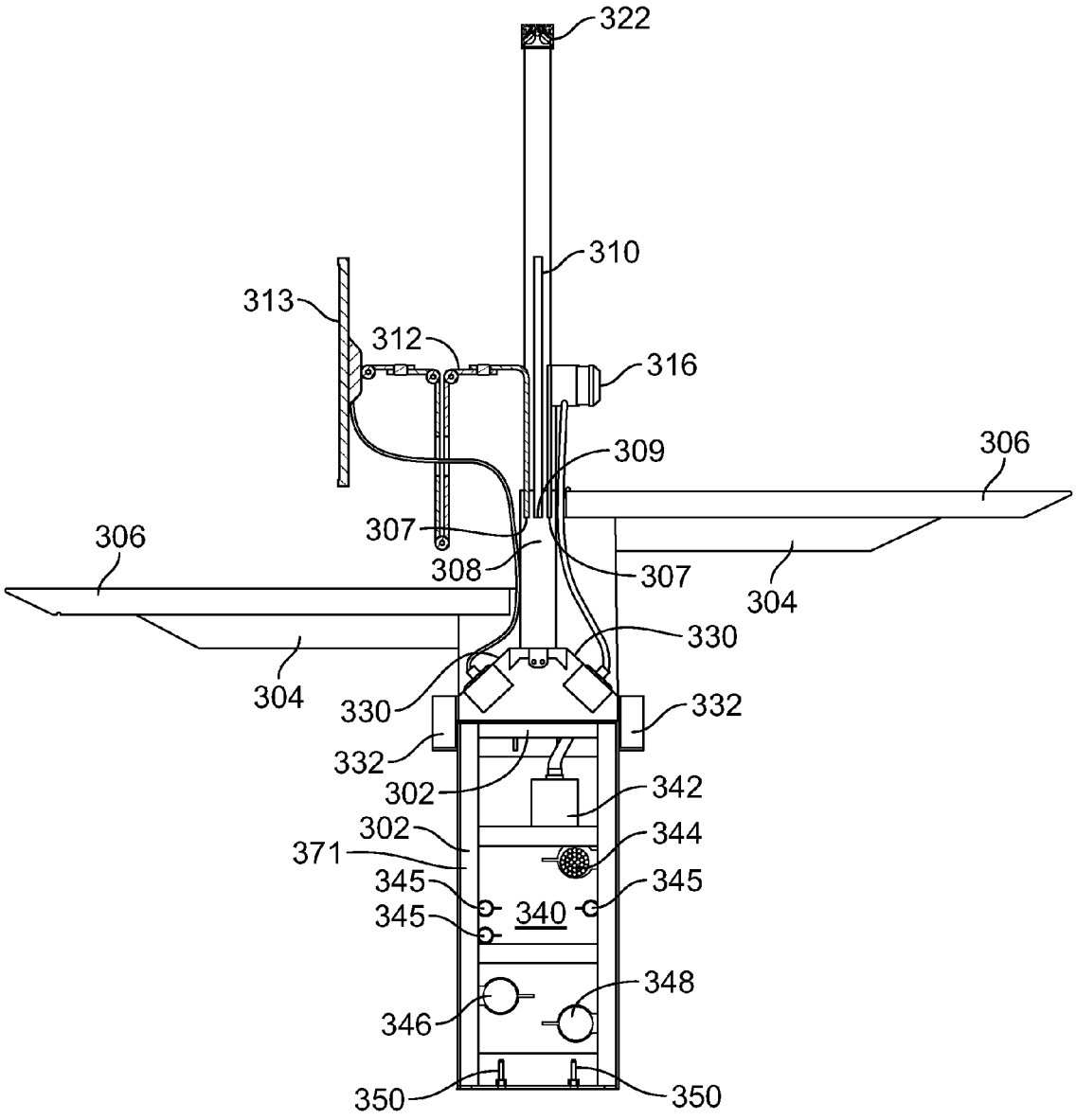
FIG. 3 illustrates a cross-sectional view of an exemplary modular laboratory workbench.

FIG. 3 illustrates a cross-sectional view of a modular laboratory workbench, such as modular laboratory workbench 100 of FIG. 1. Rectangular base structure 371 of spine structure 302 may be attached to the floor slab with bolts 350 or the like and include parallel side walls defining a core passageway 340. Various utilities may be provided in core passageway 340 including air and water plumbing 346 and 348 (which may include cold water plumbing, hot water plumbing, exhaust air plumbing, pressurized air plumbing, vacuum plumbing, waste water plumbing, sewer return plumbing, etc.). Electrical line 344 and gas and data lines 345 may include various power supply lines from multiple circuit breakers as discussed above, telephone and data lines, various gas lines, and the like. Typical support structures and attachment mechanisms may be provided within core passageway 340 for holding or otherwise securing utilities (e.g., wire baskets, brackets, screws, bolts, channels, conduits, straps, etc.). Transformer 342 may be hard-wired to a power supply line or plugged into a provided power outlet. Transformer 342 may convert the alternating current of the power supply line to direct current to power task light 322. In other embodiments, transformer 342 may be plugged into a power outlet provided on angled face 330 of spine structure 302. Angled faces 330 may provide connections to each of the utilities routed through the workbench, and may be accessed by sliding work surfaces 306 away from the spine along slides, glides, rollers, or tracks connecting work surfaces 306 to support brackets 304.

Accessory support structure 308 may be attached to spine structure 302 in between angled faces 330 using 'L' brackets screwed into both spine structure 302 and accessory support structure 308 or may be attached using screws, bolts, adhesives, or the like. In one embodiment, accessory support structure 308 may be machined from a solid piece of aluminum or the like to provide structural support as well as to allow for precise fittings. As illustrated, accessory support structure 308 may be significantly narrower than spine structure 302. As such, accessory support structure 308 may provide support to various work surface accessories while providing a sleek look to the workbench and providing more work surface space than prior designs that may have extended most or all of spine structure 302 above the work surface height. In addition, the narrow space occupied by accessory support structure 308 may leave sufficient space on either side for routing wires, cables, hoses, and the like behind work surfaces 306 and down to angled faces 330, thereby keeping work surface 306 clear and unobstructed and providing more usable space than prior designs.

Accessory support structure 308 may include center channel 309 (e.g., a 1.5 inch deep channel) that receives and holds backsplash 310, a channel or slot on one or both distal ends (not shown) to interface with a stem of task light 322, and accessory slots 307 on either side of the center channel for work surface accessories. For example, monitor arm 312 may be configured to secure into accessory slot 307 of accessory support structure 308 and to support monitor 313. Similarly, gas turret 316 may be configured to secure into another accessory slot 307 of accessory support structure 308. As mentioned above, such accessories may be interchangeable in any of the accessory slots provided in accessory support structure 308.

As shown in FIG. 3 and mentioned above, cables, hoses, and the like from work surface accessories and work surface devices may be routed in between accessory support structure 308 and work surface 306. For example, a power cable to supply power to monitor 313 may be routed from the monitor down a gap between work surface 306 and accessory support structure 308. The power cable may then be plugged into a power outlet provided on angled surface 330. Excess power cabling, excess hose, excess wires, and the like may be bundled or otherwise gathered and permitted to rest in wire basket 332 immediately beneath angled surface 330. Wire baskets 332 may thus collect excess cabling and the like beneath work surface 306 to limit work surface clutter and keep excess cabling and the like organized. Wire baskets 332 may be provided for each spine structure module, or one or more wire baskets may extend along two or more spine structure modules. In some embodiments, wire baskets 332 may be welded to a spine structure panel or cover or otherwise attached using screws, bolts, or the like.

Figure 4:
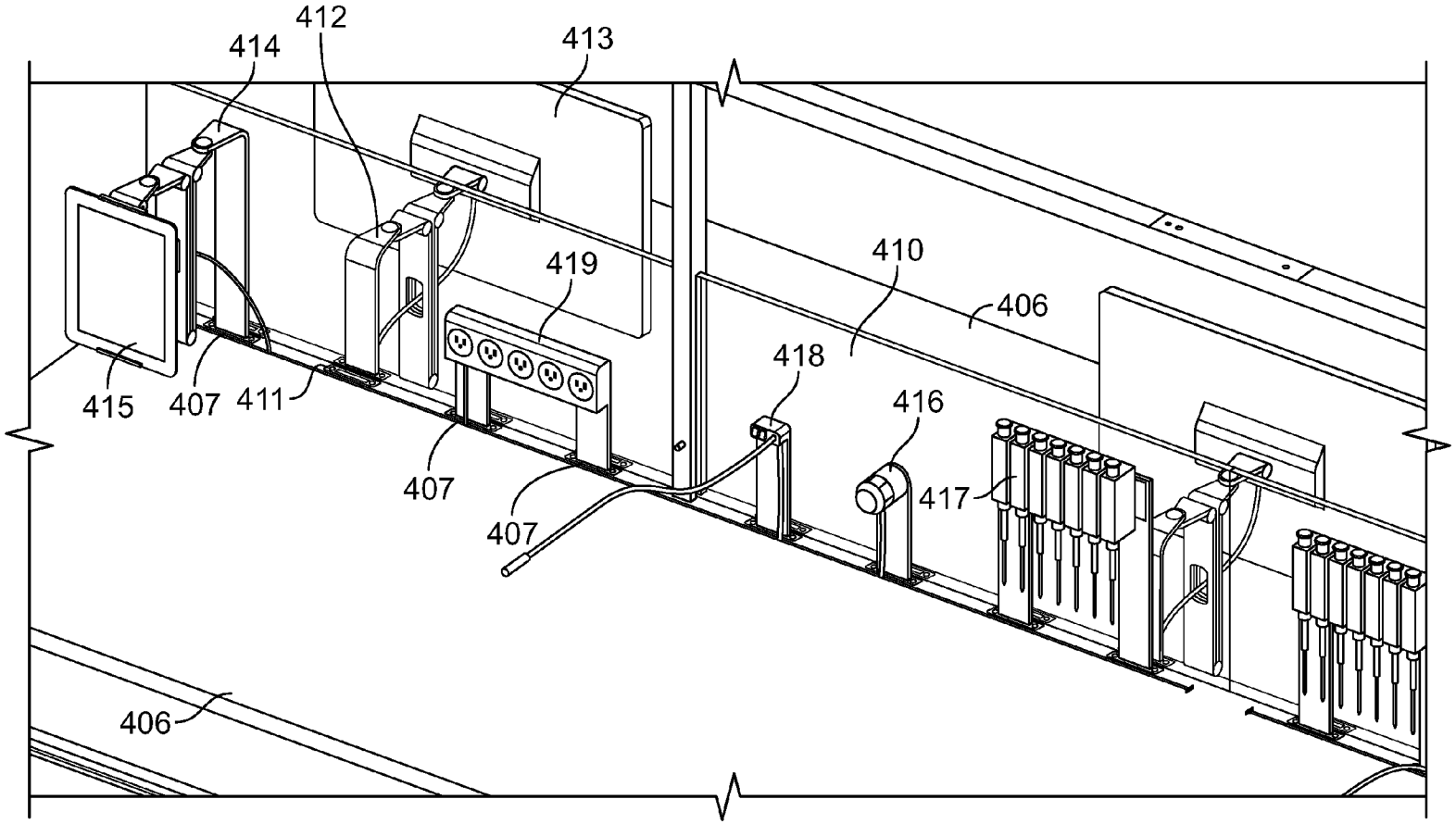
FIG. 4 illustrates interchangeable work surface accessories for an exemplary modular laboratory workbench.

FIG. 4 illustrates a variety of interchangeable work surface accessories that may be secured into accessory slots of accessory support structures as discussed above to customize a work surface space as desired. All accessories discussed herein may be configured with a connector portion that is sized to create an interference fit (press fit or friction fit) when secured into an accessory slot. Accessory slots may be machined to a particular rectangular shape with a particular size, and the connector portions of accessories may be machined to a matching particular rectangular shape and particular size such that the two parts are effectively fastened and held together by simply inserting the accessory into the slot. However, in some embodiments, screws or other fasteners may also be provided to further secure the accessories to the accessory slot (and screw holes or other fastener receptacles may be provided as part of each accessory slot). For example, each accessory may be secured to the accessory slot by both a press fit into the slot as well as screws secured on sides of the slot.

Monitor arm 412, for example, may secure into one accessory slot 407 behind backsplash 410. Monitor arm 412 may connect to and support monitor 413 and provide adjustment such that monitor 413 may be adjusted horizontally, vertically, and angularly (i.e., up to six degrees of freedom). Similarly, tablet arm 414 may secure into another accessory slot 407 and support tablet computer 415. Tablet arm 414 may include clasps, channels, ledges, or the like for securing tablet computer 415 Like monitor arm 412, tablet arm 414 may be adjustable horizontally, vertically, and angularly (i.e., up to six degrees of freedom). As accessory slots 407 are provided at intervals all along work surface 406, some accessory slots may not be used in some work spaces. To prevent dust, debris, liquid, or the like from entering an unoccupied accessory slot 407, placeholder 411 may be provided that secures into the slot.

Other accessories may also be provided that may secure into accessory slots 407 to customize work surface spaces. For example, power strip 419 may secure into two adjacent accessory slots and provide power outlets above work surface 406. In one embodiment, power strip 419 may include five power outlets. Power strip 419 may itself plug into a power outlet below work surface 406 on an angled top surface of the spine structure to receive electrical power, or it may be hard-wired to an electrical supply line in the spine structure of the workbench. Although illustrated with two legs occupying two accessory slots, other embodiments of power strip 419 may have only one leg and occupy only one accessory slot. Supplemental light 418 may also be provided and may also secure into accessory slot 407. Supplemental light 418 may include a fiber optic light that is flexible or malleable to be angled to illuminate particular work surfaces or laboratory equipment as desired. Supplemental light 418 may include a button or switch to control the light. Supplemental light 418 may include a plug that may be plugged into a power outlet below work surface 406 on an angled top surface of the spine structure to receive electrical power. A transformer and light source may be incorporated into the plug, the cable, or the structure above work surface 406.

Gas turret 416 may also be provided and may also secure into accessory slot 407. Gas turret 416 may include a nozzle, connector, pipe, hose, or other interface for delivering gas to laboratory equipment, hoses, and the like at the work surface. Gas turret 416 may include a dial, knob, or like mechanism for controlling the flow of gas. Gas turret 416 may connect to a gas supply fitting below work surface 406 on an angled top surface of the spine structure to receive gas. Pipette holder 417 may also be provided and may secure into two adjacent accessory slots 407. Pipette holder 417 may provide a sturdy location to secure pipettes while also holding them out of the way of work surface 406. In other embodiments, pipette holder 417 may secure into only one accessory slot. Pipette holder 417 may include ledges, hooks, cutouts, or the like for holding any number of a variety of pipettes (e.g., seven typical pipettes as illustrated).

The various work surface accessories described herein are provided as examples only, and many other accessories and variations on the described accessories will be apparent to those of ordinary skill in the art. Various other work surface accessories may also be outfitted with a connector to secure into accessory slots as described herein, providing support to a variety of tools, devices, and desk accessories.

Figure 5:
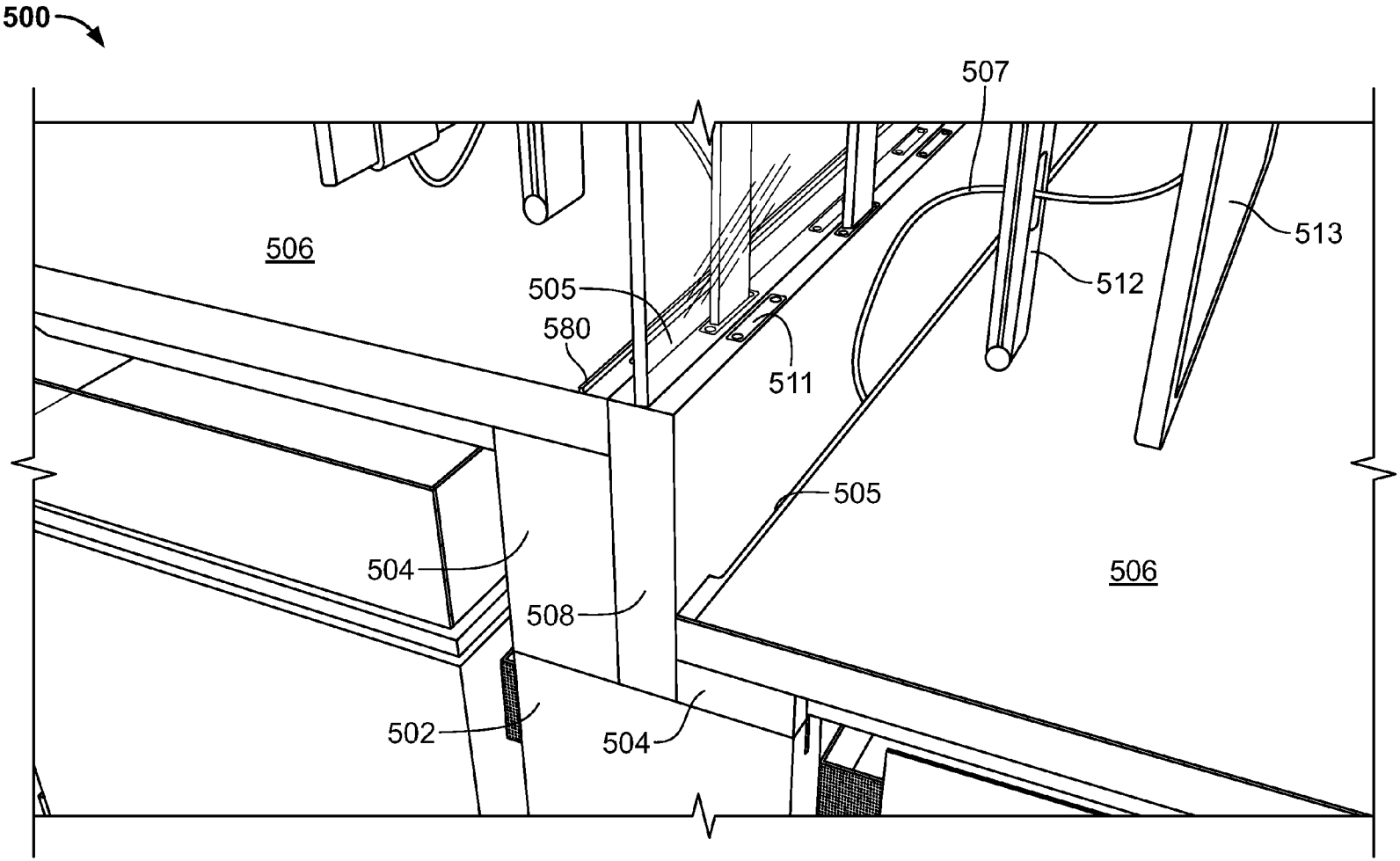
FIG. 5 illustrates an exemplary modular laboratory workbench with a translatable work surface in a closed position.

FIG. 5 illustrates modular laboratory workbench 500 with translatable work surfaces 506 in closed positions. Work surfaces 506 may be secured to support brackets 504 on spine structure 502 using tracks, glides, rollers, slides, or the like to enable work surfaces 506 to translate perpendicularly away from accessory support structure 508. In FIG. 5, work surfaces 506 may be in the closed position, abutting accessory support structure 508. Notably, however, gap 505 may remain to allow cables, hoses, wires, and the like to pass from above work surface 506 to below the surface to connect to devices, power outlets, gas sources, or the like, some of which may be on angled faces of spine structure 502. For example, computer monitor 513, secured to monitor arm 512, may have power cable and/or data cable 507 that may be routed through monitor arm 512 and down gap 505 to plug into a power outlet, laptop computer, desktop computer, data source, or the like under work surface 506. Gap 505 thus aids in wire routing to keep work surface 506 free of clutter to make efficient use of the space.

In some embodiments, gap 505 of work surface 506 may have marine edge 580 along one edge to prevent liquid or other debris from falling or flowing from work surface 506 down gap 505. For example, as illustrated in FIG. 5, marine edge 580 may be placed along the back of work surface 506, with gap 505 in between marine edge 580 and accessory support structure 508. Should liquids be spilled on work surface 506, marine edge 580 may act as a backstop to prevent liquid from flowing down gap 505. Should any liquid flow over marine edge 580 and down gap 505, it may flow down an angled face of spine structure 502 to eventually pool on the floor, thereby reducing liquid interaction with any power outlets, data network outlets, gas outlets, or other connection points on the angled face of spine structure 502.

In one embodiment, a work surface may have a drip edge on the underside that may direct spilled liquids to fall to the floor in a particular location. For example, a drip edge may be similar to marine edge 580 and may be positioned on the underside of a work surface where, for example, the curvature or angle of a work surface edge turns smooth or flat. In another embodiment, the drip edge may include a recessed channel or slot into the underside of the work surface. As illustrated in FIG. 1 and FIG. 3, the work surface edge near personnel may have a curved or angled front (e.g., bullnose). A drip edge similar to marine edge 580 or a drip edge including a recessed channel or slot may be positioned at the bottom of the curved or angled front edge where the work surface transitions to a flat underside. Liquids spilled on the work surface may flow down the curved or angled front edge and be directed to the floor by the drip edge (whether protruding like marine edge 580, recessed into the underside, or otherwise). Beneficially, liquids may not flow further back under the work surface and may be directed to fall in front of any storage modules under the work surface rather than on top of storage modules (which may have open top drawers, shelves, laptop computers, or the like on top that could be damaged by liquid).

Referring again to FIG. 5, placeholder 511 may be the same or similar as placeholder 411 of FIG. 4, and may prevent dust, debris, and the like from falling into or filling unused accessory slots of accessory support structure 508. As illustrated, placeholder 511 may include two securing screws on two sides of its rectangular shape. In other embodiments, placeholder 511 may include plastic pieces that occupy the screw holes in accessory support structure 508 instead of actual screws.

Figure 6:
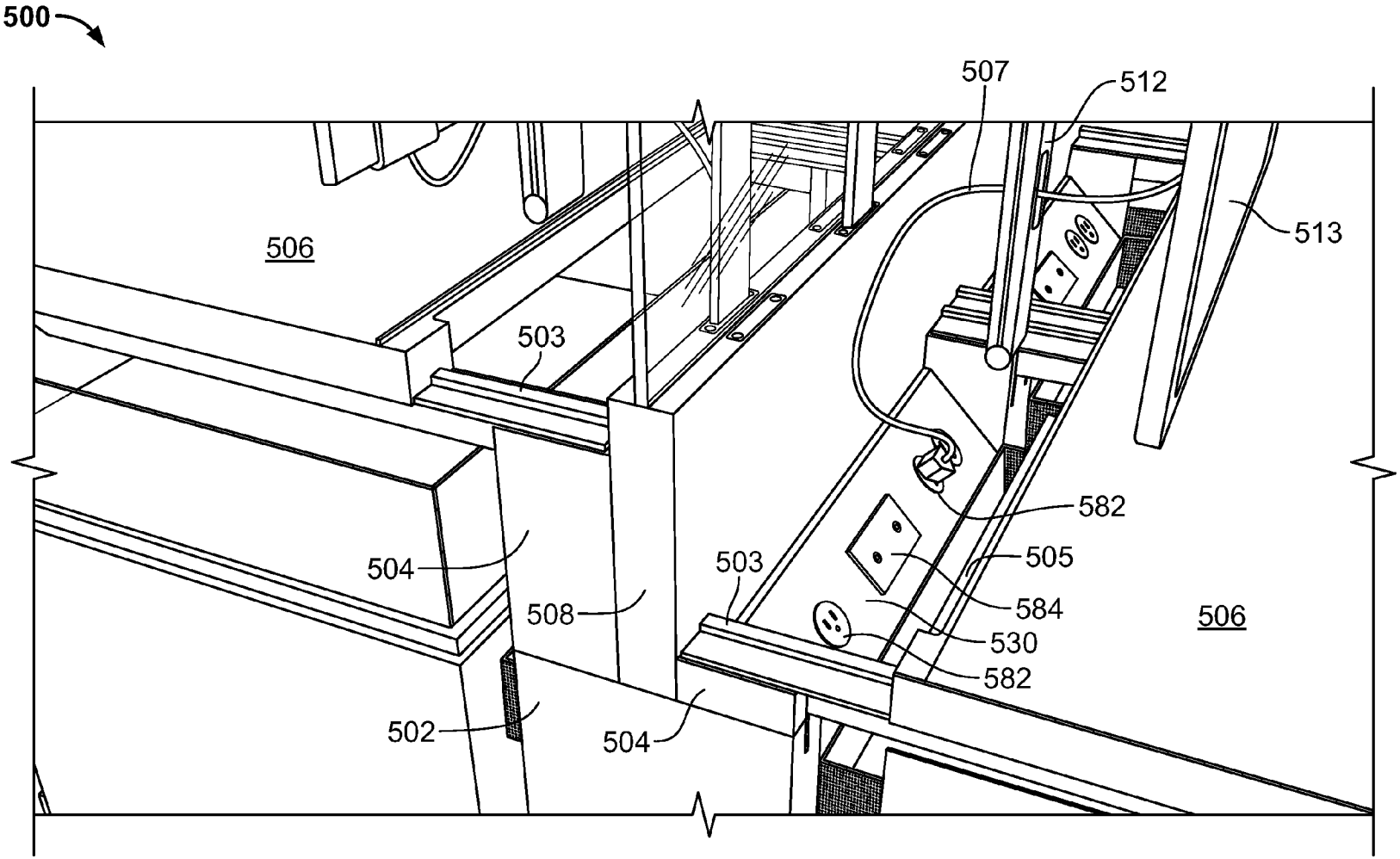
FIG. 6 illustrates an exemplary modular laboratory workbench with a translatable work surface in an extended or open position.

FIG. 6 illustrates modular laboratory workbench 500 with translatable work surfaces 506 in open positions. Work surfaces 506 may be secured to spine structure 502 on support brackets 504 on tracks 503 (or glides, rollers, slides, or the like) to enable work surfaces 506 to translate perpendicularly away from accessory support structure 508 as shown. In FIG. 6, work surfaces 506 may be in the open position, slid away from accessory support structure 508. Translating work surface 506 away from accessory support structure 508 may allow laboratory personnel easy access to angled face 530 of spine structure 502 to connect to utilities provided there such as power outlets 582 or gas, air, water, or data connections 584, or various other terminals. For example, monitor 513 may have power cable 507 that may be routed through monitor arm 512 and down behind work surface 506 to be plugged into power outlet 582. Sliding work surface 506 to the open position may thus permit a user easy access to plug monitor 513 into outlet 582 (or connect to any other utilities provided there). Closing work surface 506 (or translating it in to abut accessory support structure 508) may still leave gap 505 to permit wires, cables, hoses, and the like (such as wire 507) to pass in between work surface 506 and accessory support structure 508, which may help keep work surface 506 free of excess clutter.

Figure 7:
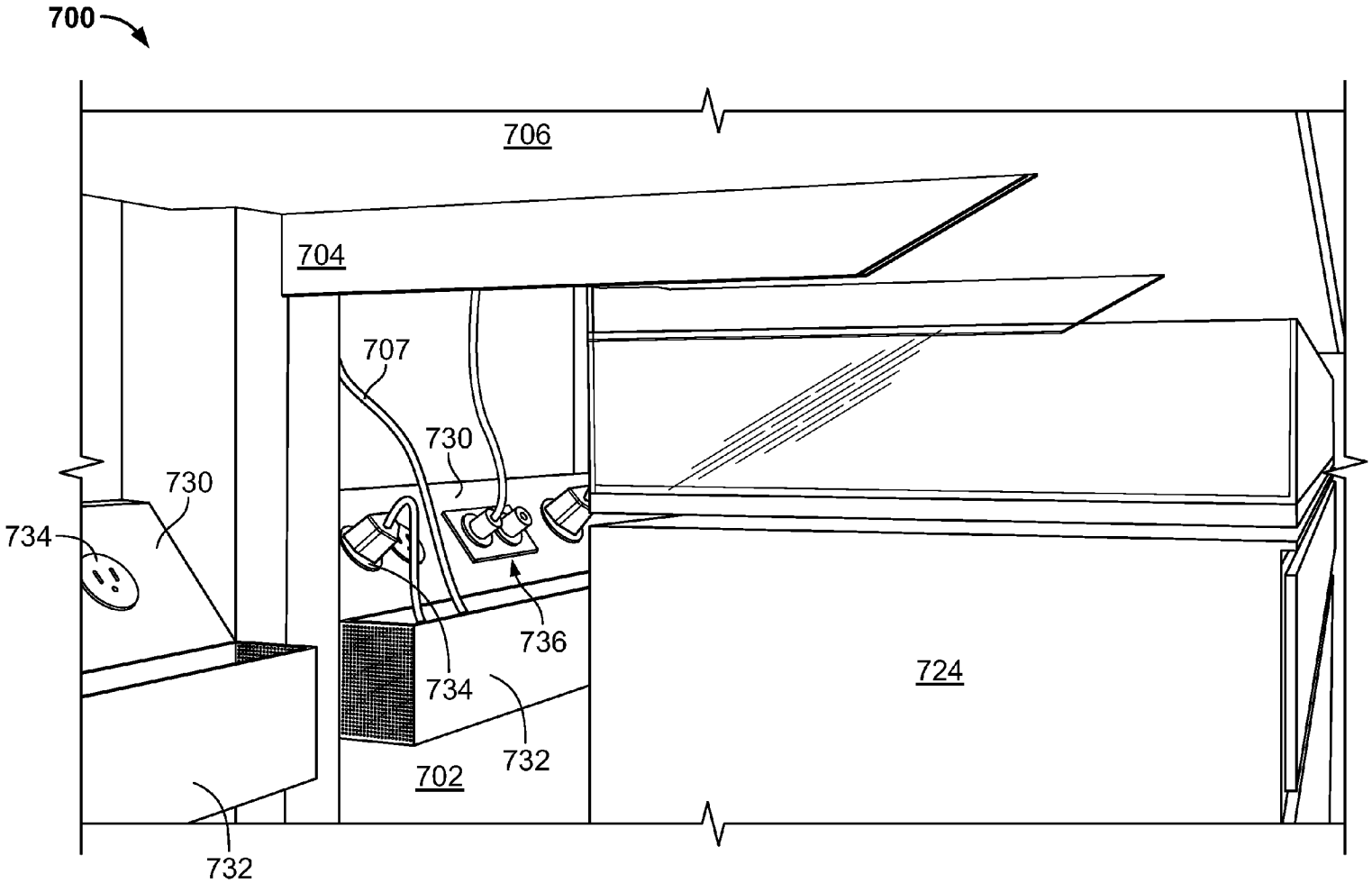
FIG. 7 illustrates the underside of an exemplary modular laboratory workbench.

FIG. 7 illustrates the underside of work surface 706 on support bracket 704 on spine structure 702 of modular laboratory workbench 700. Angled faces 730 of spine structure 702 may include various utility connections for supplying various utilities for laboratory personnel use. For example, power outlets 734 may be provided to supply electrical power for devices on work surface 706 (e.g., monitors, laboratory equipment, tools, etc.). For example, power outlet 734 may provide power to a computer monitor via power cable 707 that may be routed to the top of work surface 706. In one embodiment, power outlets 734 may include ground fault circuit interrupters (GFCI) to provide local protection against ground faults (e.g., from spilled liquids, overloaded circuits, short circuits, etc.). Typical test and reset buttons may be provided (not shown) in conjunction with power outlets 734 to test the GFCI as well as reset it if tripped.

Angled surface 730 may also include connection 736 that may supply any of a variety of gases, liquids, electricity, telephone, data, etc. For example, connection 736 may provide water, gas, compressed air, a vacuum connection, a sewer or waste water connection, an Ethernet connection, a telephone connection, or the like.

Wire baskets 732 may be attached to spine structure 702 and may collect excess cabling and the like beneath work surface 706 to limit work surface clutter and keep excess cabling and the like organized to prevent it from creating a hazardous condition of left dangling too far below work surface 706. For example, wire basket 732 may collect the excess length of power cable 707 and prevent it from descending further below where it may be kicked by the feet of laboratory personnel, potentially causing it to come unplugged or to pull on equipment on work surface 706. Excess portions of hoses, cables, wires, or the like may thus be collected in wire baskets 732. As illustrated, in one embodiment, separate wire baskets 732 may be provided for different sections of spine structure 702 (i.e., on separate spine structure modules). In other embodiments, a single wire basket may run the length of a workbench or some other distance. Wire baskets 732 may include vents, holes, perforations, or the like on the bottom and/or the sides to allow for air flow as well as liquid flow should liquid enter the baskets. For example, liquid that falls on angled surface 730 may flow into wire baskets 732 and drain onto the floor through the provided vents, holes, perforations, or the like, thus beneficially directing any stray liquids to the floor away from electronics, cables, gases, and the like. In some embodiments, wire baskets 732 may be welded to a panel or cover of spine structure 702 (e.g., welded to panel 272 of FIG. 2) or otherwise attached using screws, bolts, or the like.

Storage module 724 may include casters and be movable to be repositioned throughout the laboratory. Storage module 724 may include an upper shelf with glass sides permitting laboratory personnel to easily view its contents. Storage module 724 may also include a variety of drawers, shelves, cabinets, or the like of a variety of desired sizes. As illustrated, storage module 724 (as with any other storage modules discussed herein) may rest against wire basket 732 when pushed fully back underneath work surface 706. In other embodiments, wire basket 732 may be excluded and storage module 724 may rest directly against spine structure 702.

Figure 8A:
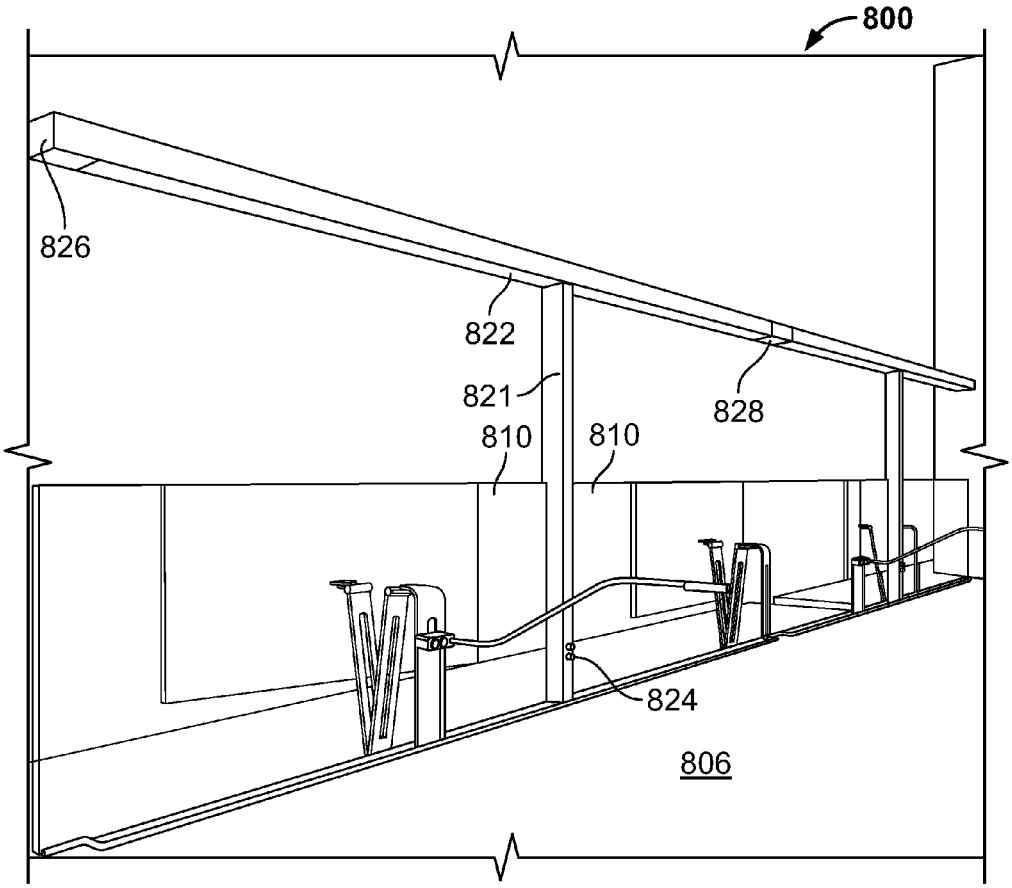
FIG. 8A illustrates an exemplary modular laboratory workbench with task lighting.

FIG. 8A illustrates modular laboratory workbench 800 with task light 822 for illuminating work surface 806. Task light 822 may also include column or stem 821 to secure to the spine structure and/or to accessory support structure of workbench 800. Column or stem 821 may include channels on one, two, or more sides for interfacing with backsplashes 810 and/or an accessory support structure to provide structural support to both backsplashes 810 and stem 821. In other embodiments, backsplashes 810 may be topped with a metal plate, metal bar, or similar element (not shown) to allow personnel to magnetically hang papers and the like.

Column or stem 821 may also include a conduit or hollow passageway for routing electrical wiring to supply power to the lighting elements of task light 822. Task light 822 may be hardwired to electrical lines in workbench 800, or it may be plugged into an outlet provided on workbench 800. A transformer to convert electricity may be provided within column 821 or below work surface 806 within the spine structure of workbench 800 or as part of the power plug of task light 822. Buttons 824 (which may also be a switch, dial, or other control) may be provided on column 821 for controlling the lighting elements of task light 822. Multiple task lights 822 may be provided along a workbench. At an end of a string of task lights, an end cap 826 may be provided to terminate the string and close the space to prevent dust and debris from entering, as well as to provide a clean look. Between two task lights 822, connector 828 may be provided to connect two task lights to provide mutual structural support as well as to close the space to prevent dust and debris from entering, as well as to provide a clean look.

Figure 8B:
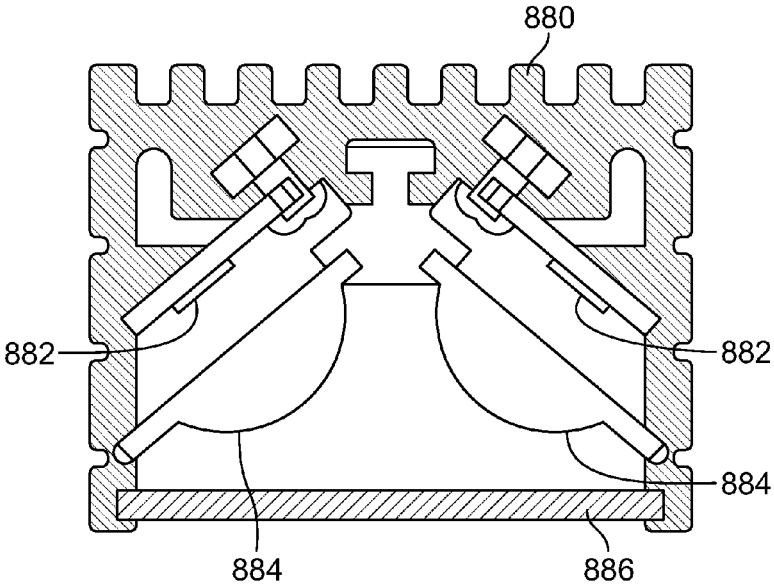
FIG. 8B illustrates a cross-sectional view of an exemplary task light.

FIG. 8B illustrates a cross-sectional view of task light 822. Task light 822 may include a housing that includes aluminum or other heat conductive materials. Task light 822 may include grooved or ridged top surface 880 for aiding in heat dissipation. Task light 822 may include light emitting diode (LED) lights 882 at 45° angles to illuminate work surfaces on either side of task light 822. Multiple LEDs 882 may be provided in a line all along task light 822. Cylindrical lenses 884 may be provided, also at 45° angles, to spread the light produced by LEDs 882. Similarly, diffusion sheet 886 may be provided at the bottom of task light 822 to diffuse the light for optimal viewing. In one embodiment, diffusion sheet 886 may include acrylic or the like. In some embodiments, one or more reflectors may be provided to reflect the light within task light 822 and direct as much light as possible toward the work surfaces.

Although only certain exemplary embodiments have been described in detail above, those skilled in the art will readily appreciate that many modifications are possible in the exemplary embodiments without materially departing from the novel teachings and advantages of this disclosure. For example, aspects of embodiments disclosed above can be combined in other combinations to form additional embodiments. Accordingly, all such modifications are intended to be included within the scope of this disclosure.

What is claimed is:

1. A modular laboratory workbench comprising:

a spine structure for supporting two or more translatable work surfaces, the spine structure comprising:

two parallel walls defining a passageway for routing one or more utilities; and two angled faces positioned atop the parallel walls and angled toward each other;

an accessory support structure attached to a top portion of the spine structure, extending up therefrom, and running longitudinally along the spine structure, the accessory support structure comprising:

a center channel extending along the length of the accessory support and configured to receive a backsplash; and a plurality of accessory slots along the length of the accessory support provided on both sides of the center channel;

two or more cantilever brackets attached to the spine structure; and two or more translatable work surfaces attached to the two or more cantilever brackets.

2. The modular laboratory workbench of claim 1, wherein the two or more work surfaces are translatable in a direction perpendicular to the accessory support structure.

3. The modular laboratory workbench of claim 1, wherein the two or more work surfaces translate on a track attached to the two or more cantilever brackets.

4. The modular laboratory workbench of claim 1, further comprising:

a backsplash secured in the center channel of the accessory support structure.

5. The modular laboratory workbench of claim 4, wherein the backsplash comprises glass.

6. The modular laboratory workbench of claim 1, further comprising:

a plurality of circuit breakers in the spine structure.

7. The modular laboratory workbench of claim 6, further comprising:

a hinged door in the spine structure for accessing the plurality of circuit breakers.

8. The modular laboratory workbench of claim 6, further comprising:

a removable panel in the spine structure for accessing the plurality of circuit breakers, wherein the removable panel is attached to the spine structure using magnetic clips.

9. The modular laboratory workbench of claim 1, wherein the two angled faces of the spine structure are below the two or more translatable work surfaces.

10. The modular laboratory workbench of claim 9, further comprising:

one or more power outlets on the two angled faces of the spine structure, the power outlets supplied by power lines routed through the passageway of the spine structure.

11. The modular laboratory workbench of claim 10, further comprising:

one or more gas terminals on the two angled faces of the spine structure, the gas terminals supplied by gas plumbing routed through the passageway of the spine structure.

12. The modular laboratory workbench of claim 11, further comprising:

one or more water connections on the two angled faces of the spine structure, the water connections supplied by water plumbing routed through the passageway of the spine structure.

13. The modular laboratory workbench of claim 9, wherein the two or more translatable work surfaces comprise a gap adjacent to the accessory support structure for providing access to utilities on the two angled faces of the spine structure.

14. The modular laboratory workbench of claim 13, wherein the two or more translatable work surfaces comprise a marine edge adjacent to the gap.

15. The modular laboratory workbench of claim 1, the spine structure further comprising:

a basket attached to a panel of the spine structure below at least one of the two angled faces of the spine structure.

16. The modular laboratory workbench of claim 1, wherein the plurality of accessory slots of the accessory support structure is configured to receive a plurality of interchangeable work surface accessories;

wherein the plurality of interchangeable work surface accessories comprises a computer monitor arm and a tablet computer arm.

17. The modular laboratory workbench of claim 16, wherein the plurality of interchangeable work surface accessories further comprises a gas turret, a pipette holder, a supplemental light, and a power strip.

18. The modular laboratory workbench of claim 1, further comprising:

a task light, the task light comprising:

a ridged top surface for dissipating heat;

one or more stems attached to the spine structure, wherein the one or more stems are at least partially hollow, and wherein the one or more stems comprise channels for interfacing with a backsplash secured in the center channel of the accessory support structure; and electrical wiring routed through the one or more stems for powering the task light.

19. The modular laboratory workbench of claim 1, further comprising:

one or more movable storage modules under the two or more translatable work surfaces.

20. The modular laboratory workbench of claim 1, further comprising:

a chase extending vertically from the spine structure for routing utilities to the workbench.

21. The modular laboratory workbench of claim 1, wherein the two or more cantilever brackets comprise:

at least two cantilever brackets with a first height for supporting a translatable work surface at the first height; and at least two cantilever brackets with a second height for supporting a translatable work surface at the second height.

22. A modular laboratory workbench comprising:

a spine structure comprising:

two parallel walls defining a passageway for routing one or more utilities; and a top portion;

an accessory support structure, narrower than the distance between the two parallel walls of the spine structure, attached to the top portion of the spine structure, extending up therefrom, and running longitudinally along the spine structure, the accessory support structure comprising:

a center channel extending along the length of the accessory support and configured to receive a backsplash; and a plurality of accessory slots provided along the length of the accessory support on both sides of the center channel;

two or more cantilever brackets attached to the spine structure; and two or more work surfaces attached to the two or more cantilever brackets;

wherein the two or more work surfaces are above the spine structure; and wherein the accessory support structure extends above the two or more cantilever brackets.

* * * * *